US009348254B2

(12) United States Patent
Mitsunobu

(10) Patent No.: US 9,348,254 B2
(45) Date of Patent: May 24, 2016

(54) IMAGE FORMING APPARATUS

(75) Inventor: Hidetaka Mitsunobu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 936 days.

(21) Appl. No.: 13/357,649

(22) Filed: Jan. 25, 2012

(65) Prior Publication Data

US 2012/0189355 A1 Jul. 26, 2012

(30) Foreign Application Priority Data

Jan. 26, 2011 (JP) ..... 2011-013703

(51) Int. Cl.
*G03G 15/08* (2006.01)
*G03G 15/00* (2006.01)

(52) U.S. Cl.
CPC ..... *G03G 15/0808* (2013.01); *G03G 15/0887* (2013.01); *G03G 15/0889* (2013.01); *G03G 15/505* (2013.01); *G03G 15/5058* (2013.01)

(58) Field of Classification Search
CPC ..... G03G 15/0887; G03G 15/0889; G03G 15/0891; G03G 15/0865; G03G 15/0877
USPC ..... 399/258, 263, 281
See application file for complete search history.

(56) References Cited

U.S. PATENT DOCUMENTS 5,404,211 A * 4/1995 Hashimoto et al. ..... 399/126
5,809,386 A * 9/1998 Iwata ..... 399/281
5,812,917 A * 9/1998 Iwata et al. ..... 399/281
5,832,350 A * 11/1998 Kumasaka et al. ..... 399/282
6,353,720 B1 * 3/2002 Sakai et al. ..... 399/234

FOREIGN PATENT DOCUMENTS

JP H04-127177 A 4/1992
JP H06-175487 A 6/1994
JP 09171286 A * 6/1997 ..... G03G 15/06
JP H09-236979 A 9/1997
JP 10-039628 A 2/1998
JP 2001-175066 A 6/2001

* cited by examiner

*Primary Examiner* — David Gray
*Assistant Examiner* — Andrew V Do
(74) *Attorney, Agent, or Firm* — Panitch Schwarze Belisario & Nadel LLP

(57) ABSTRACT

An image forming apparatus includes a developer bearing body and first and second supplying members. An image bearing body and the first and second supplying members are disposed around the developer bearing body in this order. The developer bearing member rotates, and supplies a developer material to the image bearing body. The first and second supplying members rotate in contact with the developer bearing body and supply the developer material to the developer bearing body. The image bearing body is upstream of the second supplying member with respect to rotation of the developer bearing body, and the second supplying member is upstream of the first supplying member. The ratio of the circumferential speed of the first supplying member to that of the developer bearing body is larger than that of the circumferential speed of the second supplying member to circumferential speed of the developer bearing body.

15 Claims, 12 Drawing Sheets

IMAGE FORMING APPARATUS

BACKGROUND OF THE INVENTION

1. Field of the Invention

The present invention relates to an image forming apparatus including image forming apparatus such as electrophotographic printers and copying machines.

2. Description of the Related Art

Existing image forming apparatus include a photoconductive drum and a developing roller. An electrostatic latent image is formed on the photoconductive drum. The developing roller rotates in contact with the photoconductive drum to supply a developer material to the photoconductive drum, thereby developing the electrostatic latent image into a toner image. Some existing image forming apparatus include two developer material supplying rollers that rotate in contact with a developing roller to supply a developer material to the developing roller.

Japanese Patent Publication No. H10-39628 (page 4 and FIG. 1) discloses one such image forming apparatus.

However, if a high density image is printed on recording paper, the use of the dual supplying rollers can still cause some difference in image density between the lading portion and trailing portion of the recording paper.

SUMMARY OF THE INVENTION

An object of the invention is to solve the problem of using two supplying rollers.

Another object of the invention is to provide an image forming apparatus that employs two supplying rollers but is capable of printing with high print quality.

Still another object of the invention is to provide an image forming apparatus capable of minimizing the difference in image density between a leading portion of a page of the recording paper and a trailing portion.

An image forming apparatus includes a developer bearing body and first and second supplying members. The developer bearing body supplies a developer material to an image bearing body that bears an electrostatic latent image thereon, thereby developing the electrostatic latent image with the developer material. First and second supplying members supply the developer material to the developer bearing body. The second supplying member is disposed upstream of the first supplying member with respect to rotation of the developer bearing body. The circumferential speed of the first supplying member is higher than the circumferential speed of the second supplying member.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings. It will be understood that it is not intended to limit the invention to the accompanying drawings.

{Construction}

Figure 1:
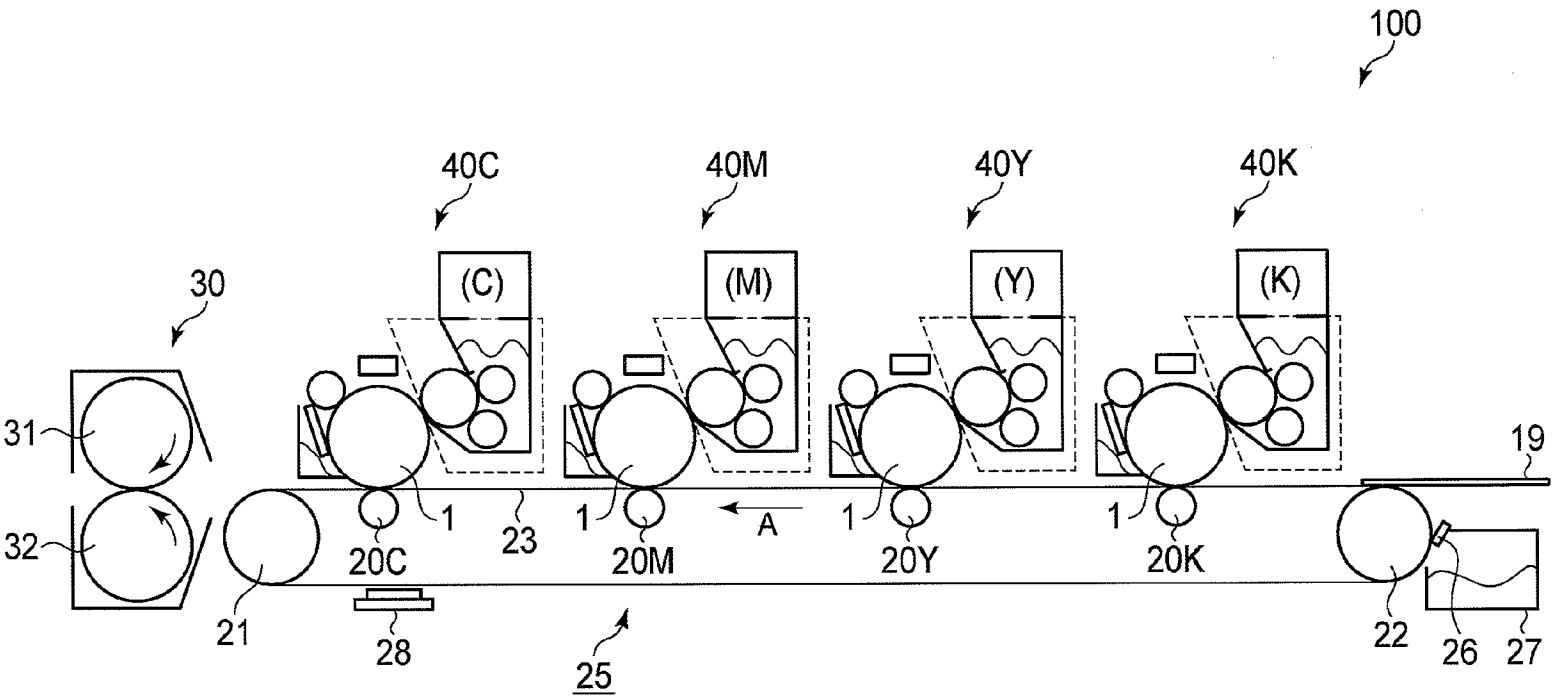
FIG. 1 illustrates the general configuration of an image forming apparatus according to a first embodiment.

FIG. 1 illustrates the general configuration of an image forming apparatus 100 according to a first embodiment.

The image forming apparatus 10 takes the form of, for example, an electrophotographic printer that utilizes a plurality of image-forming sections 40K, 40Y, 40M, and 40C in tandem. The image forming sections 40K, 40Y, 40M, and 40C form images of corresponding colors, respectively: black (K), yellow (Y), magenta (M), and cyan (C). A transfer belt 23 is disposed about a drive roller 21 and a driven roller 22, and defines a paper-transporting path. A transfer unit 25 is disposed along the paper-transport path, facing the image forming sections 40K, 40Y, 40M, and 40C. The recording paper 19 is fed from, a paper cassette (not shown), and is electrostatically attracted to the transfer belt 23. The recording paper 19 is then transported by the transfer belt 23 through the respective image forming sections in a direction shown by arrow A to a fixing section 30 located near a downstream end of the transport path. As the recording paper 19 passes through the fixing section 30, the toner image on the recording paper 19 are fused into a permanent image.

The image forming sections 40K, 40Y, 40M, and 40C are aligned along the paper-transport path. Each of the image forming sections 40K, 40Y, 40M, and 40C may be substantially identical; for simplicity only the operation of the image forming section 40K for forming black images will be described, it being understood that the other image forming sections 40Y, 40M, and 40C may work in a similar fashion.

Figure 2:
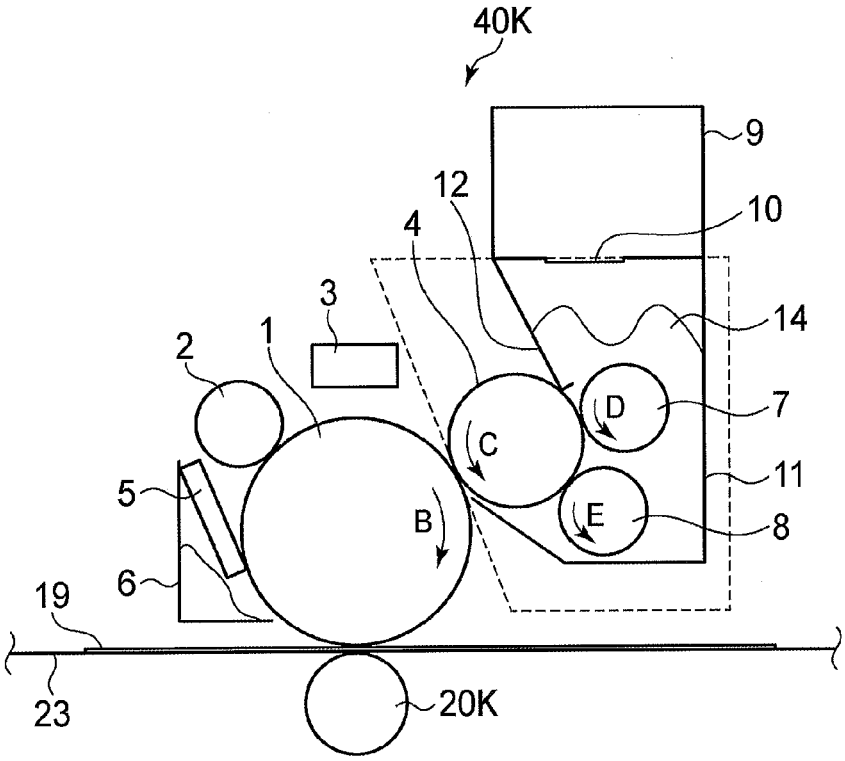
FIG. 2 illustrates the general configuration of the image forming section for black images together with a transfer belt and a transfer roller.

FIG. 2 illustrates the general configuration of the image forming section 40K together with the transfer belt 23 and transfer roller 20K.

The image forming section 40K includes a photoconductive drum 1 as an image bearing body on which an electrostatic latent image is formed. The photoconductive drum 1 rotates in a direction shown by arrow B. A charging roller 2 as a charging member, an LED head 3 as an exposing section, a developing section 15, and a cleaning blade 5 are disposed around the photoconductive drum 1 in this order. The charging roller 2 rotates in pressure contact with the photoconductive drum 1 to charge the surface of the photoconductive drum 1. The LED head 3 illuminates the charged surface of the photoconductive drum 1 to form an electrostatic latent image on the surface of the photoconductive drum 1.

The developing section 15 supplies toner of a corresponding color (black) to develop the electrostatic latent image into a toner image. The cleaning blade 5 scrapes the surface of the photoconductive drum 1 to remove the residual toner after transfer of the toner image onto the recording paper 19 on the transfer belt 23. The cleaning blade 5 is formed of an elastic material and has an edge in pressure contact with the surface of the photoconductive drum 1. The rotatable members in the image forming section 40K are driven by a drive force transmitted from a drive source (not shown) via, for example, gears (not shown).

The developing section 15 includes a toner tank 9, a toner room 11, a developing roller 4 as a developer bearing body, a first supplying roller 7 as a first supplying member, and a second toner supplying roller 8 as a second supplying member, and a developing blade 12 as a developer limiting member. The toner tank 9 stores toner 14 as a developer material. The image bearing body, first supplying roller, and second supplying roller are disposed around the developing roller in this order so that the image bearing body is upstream of the second supplying roller with respect to rotation of the developing roller, and the second supplying roller is upstream of the first supplying roller. The toner room 11 holds the toner 14 supplied from the toner tank 9. The developing blade forms a thin layer of the toner 14 on the developing roller 4. The developing roller 4 holds a thin layer of toner thereon, and rotates in contact with the photoconductive drum 1, thereby developing the electrostatic latent image into a toner image. The first supplying roller 7 and second supplying roller 8 supply the toner 14 to the developing roller 4.

The first supplying roller 7 and second supplying roller 8 parallel the photoconductive drum 1. The first supplying roller 7, second supplying roller 8, and photoconductive drum 1 rotate in directions shown by arrows D, E, and C, respectively. The developing blade 12 is positioned relative to the developing roller 4 so that the folded end portion of the developing blade 12 parallels the photoconductive drum 1 and is pressed against the circumferential surface of the developing roller 4 under uniform pressure across the length of the developing roller 4. The rotatable members in the developing section 15 are driven by a drive force transmitted from a drive source (not shown) via, for example, gears (not shown).

Figure 3:
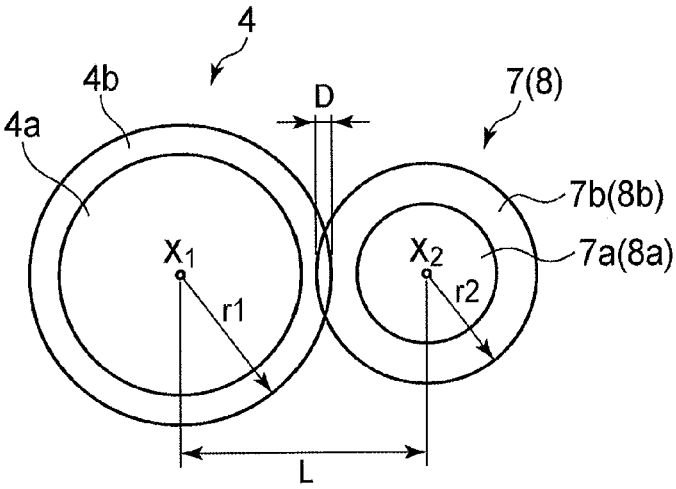
FIG. 3 illustrates the positional relationship among a developing roller, a first supplying roller, and a second supplying roller.

The configuration of the toner 14, developing roller 4, first supplying roller 7, and second supplying roller 8 will be described in detail. FIG. 3 illustrates the positional relationship among the developing roller 4, and first supplying roller 7 (or the second supplying roller 8).

The toner 14 is a pulverized developer material and has an average particle diameter of 8 μm. The toner 14 is formed of polyester resin and contains a coloring agent, a charge control agent, and a releasing agent as internal additives. An external additive, for example, hydrophobic silica, is added to the surface of the particles of the toner 14. The developing roller 4 includes a metal shaft 4*a* and an elastic body 4*b* formed on the metal shaft. For example, the metal shaft 4*a* has a diameter of 10 mm. The elastic body is formed of semi-conductive urethane rubber and has a thickness of 3 mm and a rubber hardness of 70 on the Asker C scale. The first and second supplying rollers 7 and 8 are of an identical configuration. Each supplying roller includes a metal shaft 7*a* or 8*a* having a diameter of 6 mm, and a foamed body 7*b* or 8*b* formed of foamed silicone having a thickness of 3.5 mm, and a hardness of 50 on the Asker F scale.

Referring to FIG. 3, the distance L between the rotational axis of the developing roller 4 and the rotational axis of the first supplying roller 7 (or second supplying roller 8) is selected to be 13.5 mm. The depth D of the nip formed between the first supplying roller 7 (or supplying roller 8) and the developing roller 4 is 1.0 mm. The depth D is given by equation (1) as follows:

$$D=(r1+r2)-L \qquad \text{Eq. (1)}$$

where D is the depth of the nip, r1 is the radius of the developing roller 4, r2 is the radius of the first supplying roller 7 (or second supplying roller 8), and L is the distance between the rotational axes X1 and X2 of the first supplying roller 7 (or second supplying roller 8) and the developing roller 4.

Referring back to FIG. 1, the transfer rollers 20K, 20Y, 20M, and 20C parallel the photoconductive drums of corresponding image forming sections 40K, 40Y, 40M, and 40C, respectively, with the transfer belt 23 held therebetween in a sandwiched relation. The transfer rollers 20K, 20Y 20M, and 20C receive a high voltage, thereby developing an electric field between the transfer roller and the photoconductive drum 1 so that the toner image is transferred from the photoconductive drum 1 onto the recording paper 19.

A cleaning blade 26 scrapes the outer surface of the transfer belt 23 to remove residual toner from the transfer belt 23, thereby collecting the residual toner into a waste toner reservoir 27. A density sensor 28 is located in the vicinity of the downstream end of the transfer belt 23 with respect to the paper transport path.

The fixing section 30 incorporates a heat roller 31 and a backup roller 32 in pressure contact with the heat roller 30 to define a fixing point therebetween. As the recording paper 19 passes through the fixing point, the toner image on the recording paper 19 is fused into a permanent image under heat and pressure. The recording paper 19 is then discharged onto a stacker (not shown).

{Control Diagram}

Figure 4:
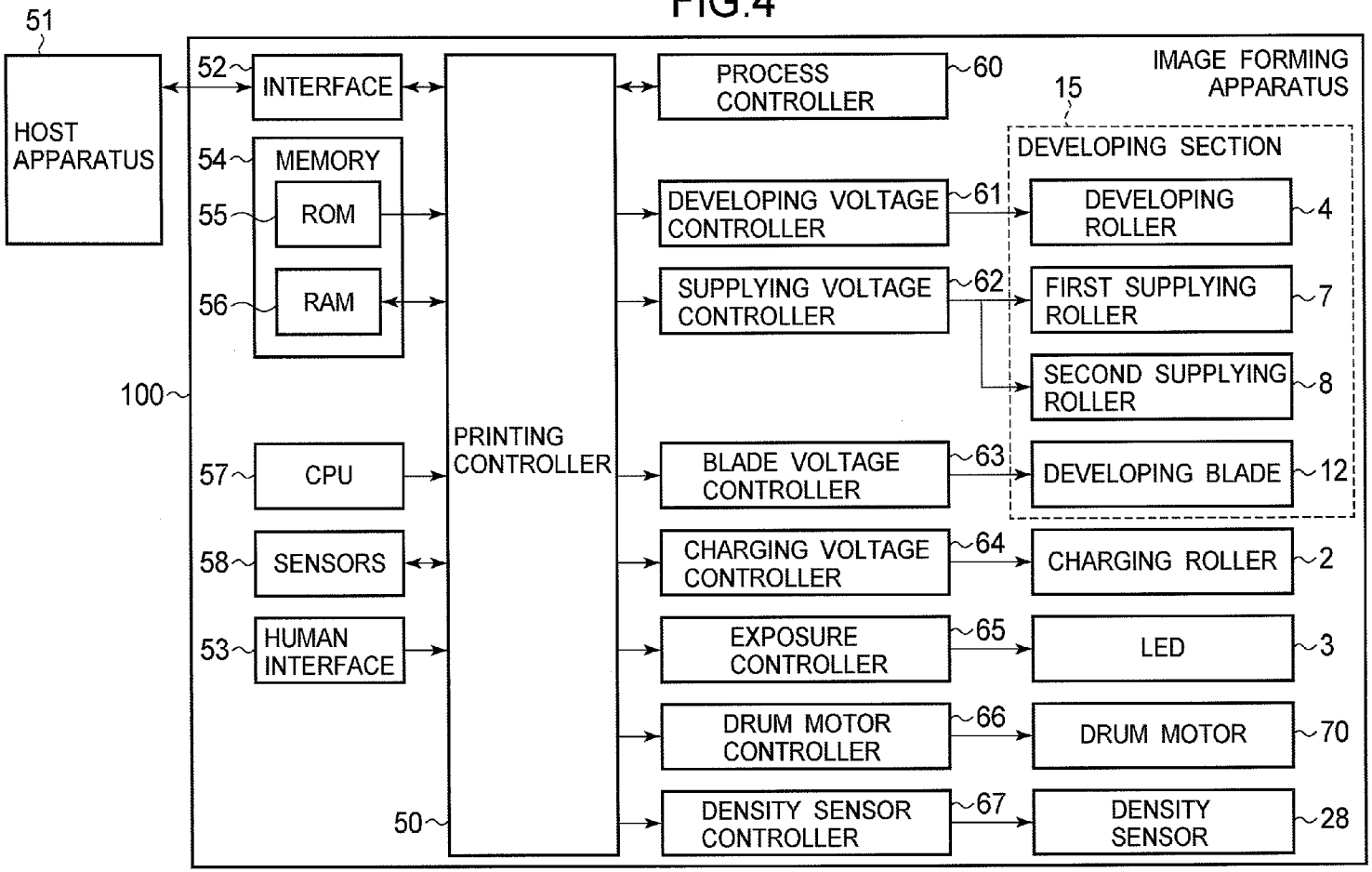
FIG. 4 is a block diagram illustrating the respective sections of the image forming apparatus, pertinent to the present invention.

FIG. 4 is a block diagram illustrating the respective sections of the image forming apparatus 100 pertinent to the present invention. The control system will be described with reference to FIGS. 1 and 2.

A printing controller 50 performs the overall control of the image forming apparatus 100. The printing controller 50 communicates signals and data with a human interface 53 and an interface 52 that receives print data from a host apparatus 51. A memory 54 includes a ROM 55 and a RAM 56. The ROM 55 stores Table 1 that lists voltages applied to the respective rollers. The RAM 56 holds a variety of data necessary for the operation of the image forming apparatus 100. The memory 54 communicates with the printing controller 50.

The printing controller 50 also communicates with and a process controller 60 and a variety of sensors 58 that detect the recording paper 19. The developing voltage controller 61 controls the voltage applied to the developing roller 4 and a supplying voltage controller 62 controls the voltages applied to the first and second supplying rollers 7 and 8. A blade voltage controller 63 controls the voltage applied to the developing blade 12. A charging voltage controller controls the voltages applied to the charging rollers of the respective image forming sections. An exposure controller 65 controls the respective LED heads 3 of the respective image forming sections.

A drum motor controller 66 drives a drum motor 70 that drives the photoconductive drums of the respective image forming sections 40*k*, 40Y, 40M, and 40C to rotate in the B direction shown in FIG. 2. The photoconductive drum 1, developing roller 4, first supplying roller 7, and second supplying roller 8 of each image forming section have gears at one longitudinal end portions thereof. The gears are in meshing engagement with each other, so that when the photoconductive drum 1 is driven in rotation, the developing roller 4, first supplying roller 7, and second supplying roller 8 are driven to rotate in the C, D, and E directions. The density sensor 28 is controller by a density sensor controller 67 and detects an image density or the density of an image formed on the transfer belt 23, and communicates with the printing controller 50.

{Printing Operation}

The operation of the image forming apparatus 100 will be described with reference to FIGS. 1, 2, and 4.

The charging roller 2 charges the surface of the photoconductive drum 1 under control of the charging voltage controller 64. As the photoconductive drum 1 rotates in the B direction, the charged surface 3 reaches a position immediately below the LED head 3, where the LED head 3 illuminates the charged surface in accordance with the print data to form an electrostatic latent image. The electrostatic latent image is developed by the developing section 15 into a toner image.

The recording paper 19 fed from the paper cassette (not shown) is transported by the transfer belt 23 toward the transfer roller 20K. When the toner image reaches a transfer point defined between the photoconductive drum 1 and the transfer roller 20K, the toner image is transferred onto the recording paper 19 on the transfer belt 23. The transfer of toner images is performed in the image forming sections 40K, 40Y, 40M, 40C in sequence, so that the toner images of corresponding colors are overlaid one over the other in registration to form a full color image.

The recording paper 19 carrying the full color toner image thereon is then transferred by the transfer belt 23 to the fixing section 30. The toner image is fused under heat and pressure in the fixing section 30. The recording paper 19 then leaves the fixing section 30 and is further transported to the stacker. After the recording paper 19 has left the transfer belt 23, the cleaning blade 26 removes the residual toner from the transfer belt 23.

{Density Setting Operation}

Figure 5:
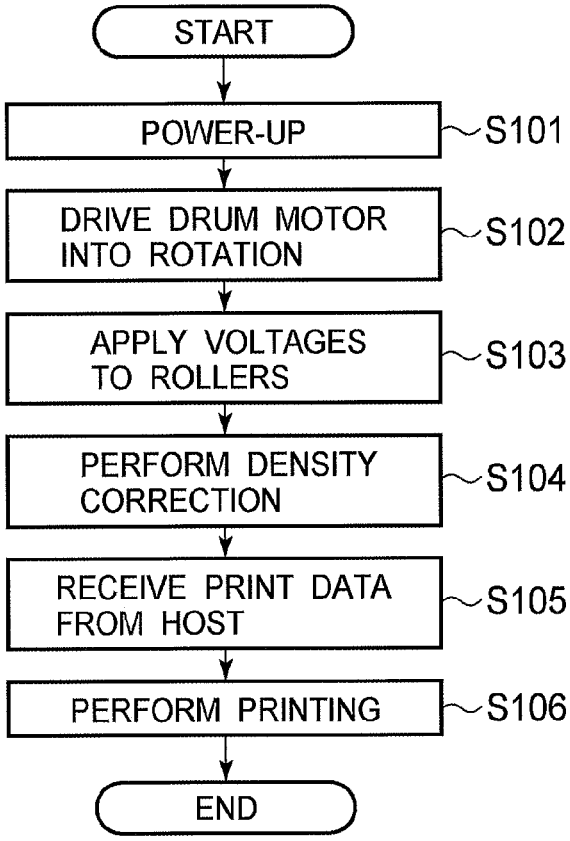
FIG. 5 is a flowchart illustrating an image density setting operation.

FIG. 5 is a flowchart illustrating an image density setting operation prior to a printing operation.

The image forming apparatus 100 performs the image density setting process prior to the printing operation. This process will be described with reference to the flowchart shown in FIG. 5. The image density setting process is performed in each of the image forming sections 40K, 40Y, 40M, and 40C. The process will be described, by way of example, with reference to the image forming section 40K.

The printing controller 50 detects when the image forming apparatus 100 is turned on (S101), and causes the motor controller 66 to drive the drum motor 70 to rotate at a predetermined rotational speed (S102). For example, the gear ratios are selected such that when the photoconductive drum 1 is driven to rotates at a circumferential speed of 130 mm/s, the developing roller 4 rotates at a circumferential speed of 156 mm/s, the first supplying roller 7 rotates at a circumferential speed of 109 mm/s, and the second supplying roller 8 rotates at a circumferential speed of 93 mm/s. In other words, the ratio of the circumferential speed of the first supplying roller 7 to that of the developing roller 4 is selected to be 0.7. The ratio of the circumferential speed of the second supplying roller 8 to that of the developing roller 4 is selected to be 0.6.

The printing controller 50 drives the charging voltage controller 64, developing voltage controller 61, and supplying voltage controller 62 to apply voltages of −1150 V, −200 V, −300 V, and −300 V to the charging roller 2, developing roller 4, first supplying roller 7, and second supplying roller 8, respectively (S103).

The printing controller 50 performs a density correction in which the image density is adjusted to a value equivalent to an optical density OD=1.5 measured with the Model X-Rite® 528 Color Reflection Densitometer available from X-Rite, Inc. (S104).

After the image density correction, the image forming apparatus 100 is then ready to perform the normal printing operation, and the printing controller 50 receives the print data from the host apparatus 51 via the interface 52 (S105). Printing is then performed (S106).

The image density is adjusted as follows:

A target image density equivalent to OD=1.5 is selected.

Test patch is a toner image used for testing the image density and is formed in accordance with a density setting. A test patch that occupies the entire printable area on the recording paper 19 is formed in the image forming section with reference voltages applied to the respective rollers at S103. The test patch is then transferred onto the transfer belt 23. The density sensor 28 reads the image density of the test patch. For example, if the image density read by the density sensor 28 is equivalent to OD=1.4, the image density is 0.1 lighter than the target image density equivalent to OD=1.5. The reference voltages applied to the respective rollers at S103 are corrected for increasing the developing efficiency. Correction bias voltage data applied to the charging roller 2, developing roller 4, first supplying roller 7, and second supplying roller for darkening the image density equivalent to that measured with X-Rite by 0.1 is read from Table 1 for correction stored in the ROM 55.

TABLE 1

| OD VALUE | 1.3 | 1.4 | 1.5 | 1.6 |
|---|---|---|---|---|
| CHARGING VOLTAGE (V) | −1210 | −1180 | −1150 | −1120 |
| DEVELOPING VOLTAGE (V) | −260 | −230 | −200 | −170 |
| SUPPLYING VOLTAGE (V) | −330 | −330 | −300 | −270 |

Thus, the charging roller 2, developing roller 4, first supplying roller 7, and second supplying roller 8 receive voltages of −1180 V, −230 V, −330 V, and −330 V respectively, thereby correcting the image density to a value equivalent to OD=1.5. It is to be noted that the respective voltages are applied while maintaining the differences in voltage among the charging roller 2, developing roller 4, first supplying roller 7, and second supplying roller 8 unchanged.

Table 1 for correction stored in the ROM 55 lists correction data that produce a corrected image density equivalent to OD=1.5 measured with the X-Rite 528 Color Reflection Densitometer. It is to be noted that the image density correction at S104 is not performed by actually using the X-Rite 528 Color Reflection Densitometer.

{Ratio of Circumferential Speed, Amount of Deposited Toner, and Image Density}

A description will be given of the relationship between the ratio of the circumferential speed of the first supplying roller 7 to that of the developing roller 4 and the ratio of the circumferential speed of the second supplying roller 7 to that of the developing roller 4*b*.

The operation in which the first supplying roller supplies the toner 14 to the developing roller 4 will be described.

Figure 6:
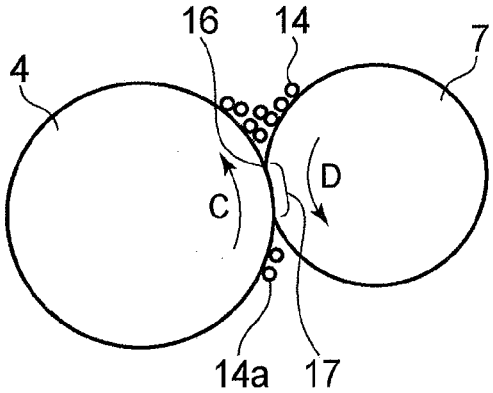
FIG. 6 is a partial expanded view of a nip formed between the developing roller and the first supplying roller.

FIG. 6 is a partial expanded view of a nip formed between the developing roller 4 and the first supplying roller 7.

The developing roller 4 and the first supplying roller 7 rotate in the C and D directions, respectively, as shown in FIG. 6. The first supplying roller 7 rotates in the D direction to scrape the residual toner 14*a* after developing the electrostatic latent image at a scraping area 17 while supplying the toner 14 to the developing roller 4 at a contact point 16. The width of the scraping area 17 is 5.56 mm if the nip depth D between the developing roller 4 and first supplying roller 7 is 1.0 mm. In order for the first supplying roller 7 to scrape the residual toner 14*a*, the width of the scraping area 17 needs to be larger than 4 mm, in which case the required nip depth D would be 0.6 mm. Conversely, if the width of the scraping area 17 is larger than 7 mm, a larger rotational torque is required which may cause the gear teeth to skip. Thus, the nip depth D should be set equal to or less than 1.4 mm and the width of the scraping area 17 should be, for example, 7 mm.

A description will be given of the relationship between the ratios of the circumferential speeds of the first and second supplying rollers 7 and 8 to that of the developing roller 4 and the amount of toner deposited on the developing roller 4 and the relationship between the ratios of the circumferential speeds of the first and second supplying rollers 7 and 8 to that of the developing roller 4 and the image density.

The test was conducted as follows:

The density correction at S104 (FIG. 5) is performed to adjust the image density of a solid black test patch to the target image density equivalent to OD=1.5.

Figure 7:
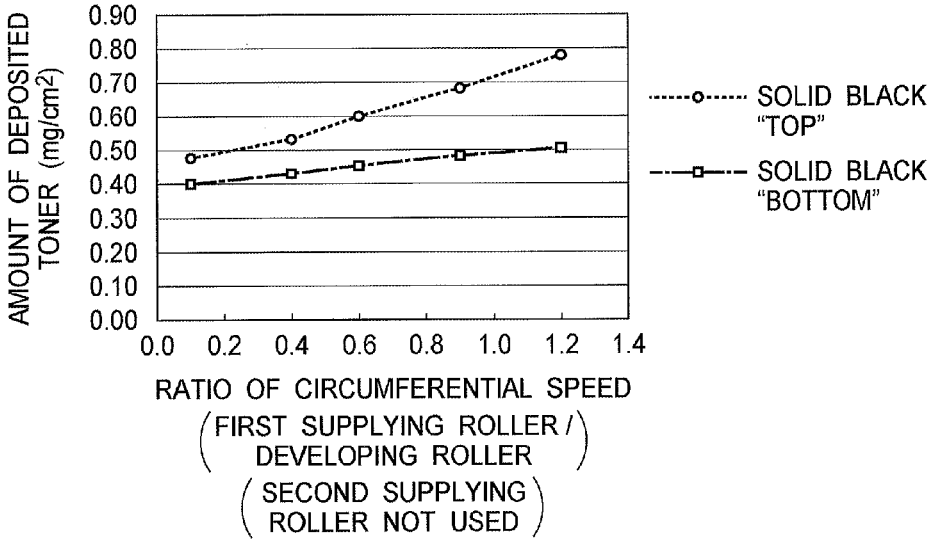
FIG. 7 illustrates the relationship between the ratio of the circumferential speed of the first supplying roller to that of the developing roller and the amount of toner deposited on the developing roller when a printing operation is performed using only the first supplying roller.

Solid black "top" is a leading portion of a solid black patch printed on the recording paper 19. Solid black "bottom" is a trailing portion of the solid black patch printed on the recording paper 19. The amount of toner (mg/cm$^2$) deposited to the developing roller 4 for printing the solid black "top" shown in FIG. 7 is the amount of toner deposited on the developing roller 4 to develop a trailing portion of a solid black image printed on A4 size recording paper 19. When printing is performed on the A4 size recording paper in a landscape orientation, the developing roller 4 needs to make about four complete rotations. Thus, the solid black "top" is the amount of toner deposited on the developing roller 4 during the first rotation of the developing roller 4, and the solid black "bottom" is the amount of toner deposited on the developing roller 4 during the fourth rotation of the developing roller 4.

The ratio of the circumferential speed of the first supplying roller 7 to that of the developing roller 4 is selected to be 0.7, and the ratio of the circumferential speed of the second supplying roller 8 to that of the developing roller 4 is selected to be 0.6. It is assumed that high quality images can be obtained if the target image density is equivalent to OD=1.5 and the difference in the density of an actual image between the solid black "top" and solid black "bottom" is equivalent to OD=1.5±0.1. It is to be noted that the image forming apparatus is configured such that the circumferential speed of the first supplying roller 7 and second supplying roller 8 can be selectively set.

{Configuration with a Single Supplying Roller}

Figure 17:
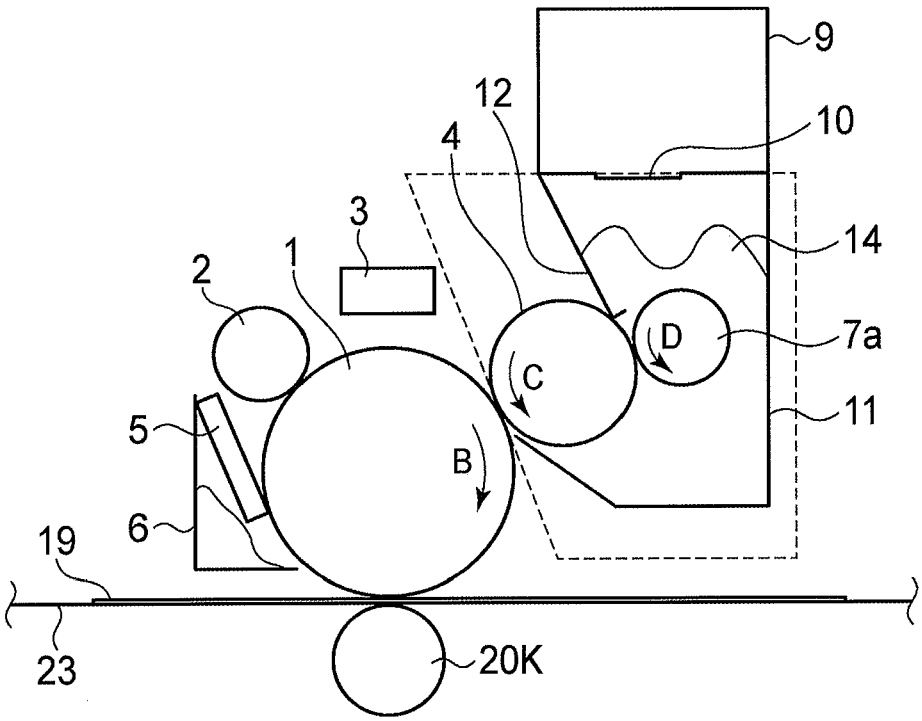
FIG. 17 illustrates a configuration in which the second supplying roller is not used.

The image forming apparatus shown in FIG. 17 has only a single supplying roller 7*a*. Using this image forming apparatus, a comparison test was conducted. The test results will be described with reference to FIG. 7.

FIG. 7 illustrates the relationship between the ratio of the circumferential speed of the supplying roller 7*a* to that of the developing roller 4 and the amount of toner deposited to the developing roller 4.

Measurements were made under the following conditions. The circumferential speed of the developing roller 4 is maintained at 156 mm/s and the circumferential speed of the first supplying roller 7*a* is varied such that the ratio of the circumferential speed of the first supplying roller 7 to that of the developing roller 4 changes from 0.1 to 1.2.

Referring to FIG. 7, the amount of toner required for printing the solid black "bottom" increases with increasing ratio of the circumferential speed of the supplying roller 7*a* to that of the developing roller 4. The amount of toner for printing the solid black "bottom" increases because the toner supplied to the contact point 16 (FIG. 6) increases with the circumferential speed of the supplying roller 7*a*.

The difference in the amount of toner deposited on the developing roller 4 between the solid black "bottom" and solid black "top" increases with the ratio of the circumferential speed of the supplying roller 7*a* to that of the developing roller 4. This is due to the fact that as the circumferential speed of the supplying roller 7*a* increases, the nip depth D between the developing roller 4 and supplying roller 7*a* decreases so that the supplying roller 7*a* and the developing roller 4 repel each other to decrease the contact area and therefore the amount of toner scraped off the developing roller 4 decreases.

As described above, if only a single supplying roller 7*a* is employed, the efficiency in scraping or removing the toner from the developing roller 4 decreases, so that the amount of toner deposited on the developing roller 4 increases and the difference in the amount of toner deposited on the developing roller 4 between the solid black "top" and solid black "bottom" increases. Conversely, if the ratio of the circumferential speed decreases, the amount of toner removed from the developing roller 4 increases so that the difference in the amount of toner deposited on the developing roller 4 between the solid black "top" and the solid black "bottom" decreases and the amount of toner deposited on the developing roller 4 also decreases.

{Configuration with a Single Supplying Roller}

Figure 8:
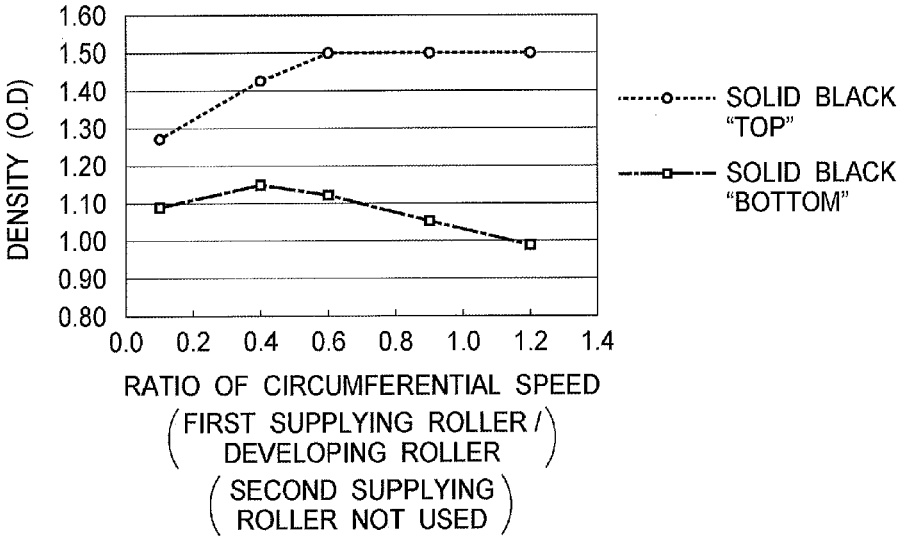
FIG. 8 illustrates the relationship between the ratio of the circumferential speed of the first supplying roller to that of the developing roller and the density of image printed on the recording paper when a printing operation is performed using only the first supplying roller.

FIG. 17 illustrates a configuration in which the second supplying roller 8 is not used. A test was conducted to evaluate the relationship between the ratio of the circumferential speed of the supplying roller 7*a* to that of the developing roller 4 and the density of an image printed on the A4 size recording paper 19. FIG. 8 illustrates the test results.

The density of a printed image was measured for the ratio of the circumferential speed of the supplying roller 7*a* to that of the developing roller 4 in the range of 0.1 to 0.2. The developing roller 4 was maintained at a fixed circumferential speed (e.g., 156 mm/s) during each measurement. Solid black "top" is a leading portion of a solid black patch printed on the A4 size recording paper 19. Solid black "bottom" is a trailing portion of a solid black patch printed on the A4 size recording paper 19. The image density of solid black "top" shown in FIG. 8, which is equivalent to an OD value measured with the Model X-Rite® 528 Color Reflection Densitometer, is the image density of the leading portion of a solid black image printed on the A4 size recording paper 19. The image density OD of solid black "bottom" shown in FIG. 8 is the image density of the trailing portion of the solid black image printed on the A4 size recording paper 19.

The difference in image density between the solid black "top" and solid black "bottom" decreases with increasing ratio of circumferential speed of the supplying roller 7*a* to that of the developing roller 4, reaching a minimum difference of OD=0.2 which is still larger than a target difference of OD=0.1. In addition, when the ratio of circumferential speed of the supplying roller 7*a* to that of the developing roller 4 decreases below 0.6, the image density of solid black "top" becomes lower than a value equivalent to OD=1.5. This implies that when the ratio of circumferential speed of the supplying roller 7*a* to that of the developing roller 4 decreases below 0.6, the amount of toner deposited to the developing roller 4 decreases below 0.60 mg (FIG. 7), preventing the image density from increasing even if the developing efficiency is increased by increasing the developing voltage.

The test results reveal that when only the single supplying roller 7*a* is used, even if the ratio of the circumferential speed of the supplying roller 7*a* to that of the developing roller 4 is adjusted, it is difficult to implement the difference in image density between the solid black "top" and solid black "bottom" lower than OD=0.1 while maintaining the image density of the solid black "top" to a level or value equivalent to OD=1.5.

{Configuration with Dual Supplying Roller}

Another test was conducted using the first supplying roller 7 and the second supplying roller 8 to evaluate the relationship between the ratio of the circumferential speed of the supplying roller 7*a* to that of the developing roller 4, the amount of toner deposited on the developing roller 4, and the image density or the density of an image printed on the A4 size recording paper.

Figure 9A:
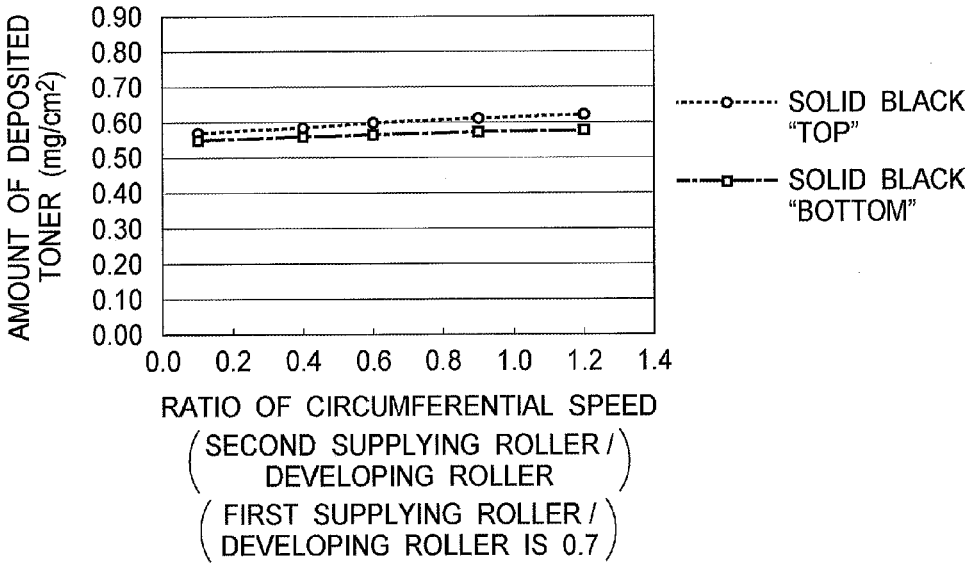
FIGS. 9A and 9B illustrate the test results of a printing operation using the first and second supplying rollers.
Figure 9B:
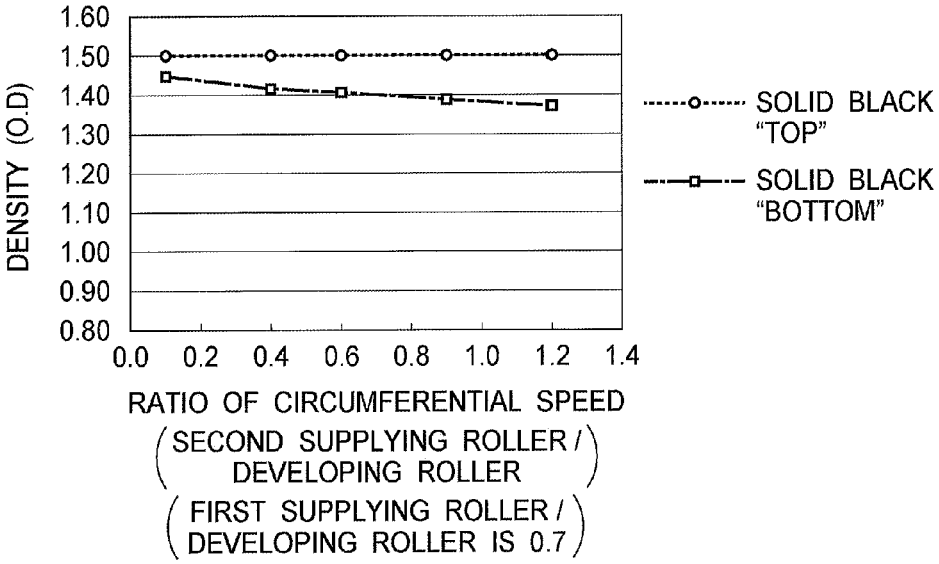

FIGS. 9A and 9B illustrate the test results. The ratio of the circumferential speed (e.g., 109 mm/s) of the first supplying roller 7 to that (e.g., 156 mm/s) of the developing roller 4 was selected to be 0.7, and the ratio of the circumferential speed of the second supplying roller 8 to that of the developing roller 8 was varied from 0.1 to 1.2.

In FIG. 9A, the amount of toner deposited on the developing roller 4 for printing the solid black "top" is the amount of toner used to print a leading portion of a solid black patch printed on the recording paper 19 with respect to the direction of travel of the recording paper 19. The amount of toner deposited on the developing roller 4 for developing a solid black "bottom" is the amount of toner used to print a trailing portion of a solid black patch on the recording paper 19. When printing is performed on the A4 size paper in a landscape orientation, the developing roller 4 needs to make about four complete rotations. Thus, the solid black "top" is the amount of toner deposited on the developing roller 4 during the first rotation of the developing roller 4, and the solid black "bottom" is the amount of toner deposited on the developing roller 4 during the fourth rotation.

Referring back to FIG. 2, the first supplying roller 7 supplies the toner 14 to the developing roller 4. The amount of toner deposited on the developing roller 4 can be at least 0.55 mg for developing the solid black "bottom" as shown in FIG. 9A even if the ratio of the circumferential speed of the second supplying roller 8 is decreased to 0.1. Also, the first and second supplying rollers 7 and 8 scrape the residual toner 14*a* from the developing roller 4, and therefore the difference in the amount of toner deposited on the developing roller 4 between the solid black "top" and solid black "bottom" can be below 0.05 mg.

In FIG. 9B, the image density OD of the solid black "top" is the image density of the leading portion of a solid black image printed on the A4 size recording paper 19. Likewise, the image density OD of solid black "bottom" is the image density of the trailing portion of the solid black image printed on the A4 size recording paper 19.

Referring to FIG. 9B, when the ratio of the circumferential speed of the first supplying roller 7 to that of the developing roller 4 is 0.7, if the ratio of the circumferential speed of the second supplying roller 8 to that of the developing roller 4 is in the range of 0.1 to 0.6, the image density of the solid black "top" can be maintained at OD=1.5 and the difference in image density between the solid black "top" and solid black "bottom" can be maintained below OD=0.1. As described above, the difference in image density between the solid black "top" and solid black "bottom" can be maintained below OD=0.1. This is considered due to the increase in the amount of scraped toner resulting from the narrow range (i.e., 0.1 to 0.6) of the ratio of circumferential speed of the second supplying roller 8 to that of the developing roller 4.

Figure 10A:
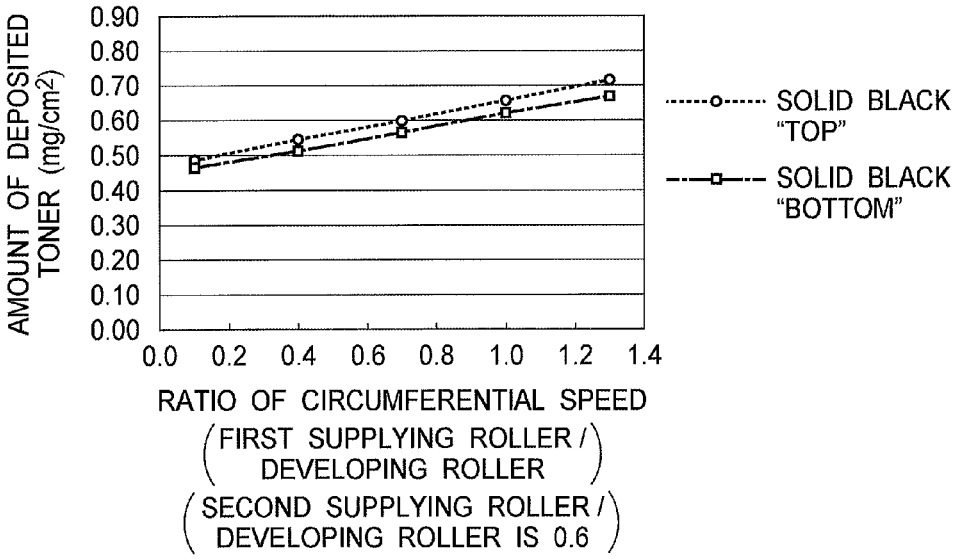
FIG. 10A illustrates the relationship between the ratio of the circumferential speed of the first supplying roller to that of the developing roller and the amount of toner deposited on the developing roller when a printing operation is performed using the first and second supplying rollers.

FIG. 10A illustrates the relationship between the ratio of the circumferential speed of the first supplying roller 7 to that of the developing roller 4 and the amount of toner deposited on the developing roller 4.

Figure 10B:
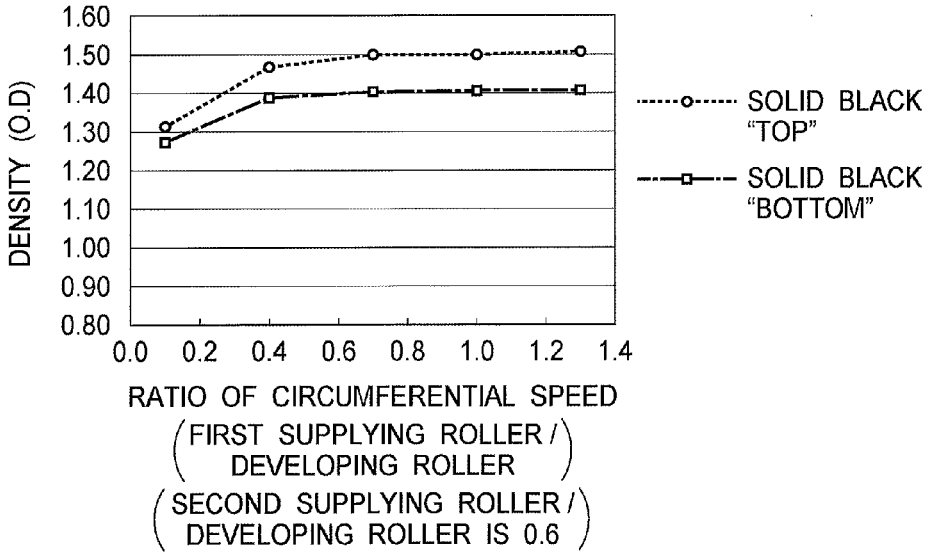
FIG. 10B illustrates the relationship between the ratio of the circumferential speed of the first supplying roller to that of the developing roller and the image density when a printing operation is performed using the first and second supplying rollers.

FIG. 10B illustrates the relationship between the ratio of the circumferential speed of the first supplying roller 7 to that of the developing roller 4 and the density of the printed image.

The ratio of the circumferential speed (e.g., 93 mm/s) of the second supplying roller 8 to that (e.g., 156 mm/s) of the developing roller 4 was selected to be 0.6, and the ratio of the circumferential speed of the first supplying roller 7 to that of the developing roller 8 was varied from 0.1 to 1.3.

The amount of toner deposited on the developing roller 4 shown in FIG. 10A is defined in the same manner as in that shown in FIG. 9A. Likewise, the image density shown in FIG. 10B is defined in the same manner as in that shown in FIG. 9B.

Referring to FIG. 10B, when the ratio of the circumferential speed of the second supplying roller 8 to that of the developing roller 4 is 0.6, if the ratio of the circumferential speed of the first supplying roller 7 to that of the developing roller 4 is in the range of 0.7 to 1.3, the image density of the solid black "top" can be maintained to a level equivalent to OD=1.5 and the difference in image density between the solid black "top" and solid black "bottom" can be maintained not higher than a level equivalent to OD=0.1.

As described above, in the present invention, print results are good if the image density of the solid black "top" is higher than OD=1.5 and the difference in image density between the solid black "top" and the image density of the solid black "bottom" is not higher than OD=0.1. Conversely, print results are poor if the image density of the solid black "top" is not higher than OD=1.5 or the difference in image density between the solid black "top" and solid black "bottom" is higher than OD=0.1. The test results reveal that when the second supplying roller 8 is positioned upstream of the first supplying roller 7 with respect to the rotation of the developing roller 4, the print results can be good if the ratio of the circumferential speed of the second supplying roller 8 to that of the developing roller 4 is smaller than the ratio of the circumferential speed of the first supplying roller 7 to that of the developing roller 4.

As described above, the image forming apparatus 100 according to the first embodiment employs two supplying rollers for a single developing roller. The two supplying rollers are disposed side by side along the rotational direction of the single developing roller, and rotate at different ratios of the circumferential speed to that of the developing roller. The ratio of the circumferential speed of a second supplying roller upstream with respect to rotation of the developing roller is selected to be smaller than that for a first supplying roller downstream of the second supplying roller. This configuration provides sufficient supply of toner to the developing roller and is sufficiently effective in scraping the residual toner from the developing roller, so that the difference in image density within a page of the recording paper 19 can be minimized for high quality print image.

Second Embodiment

Figure 11:
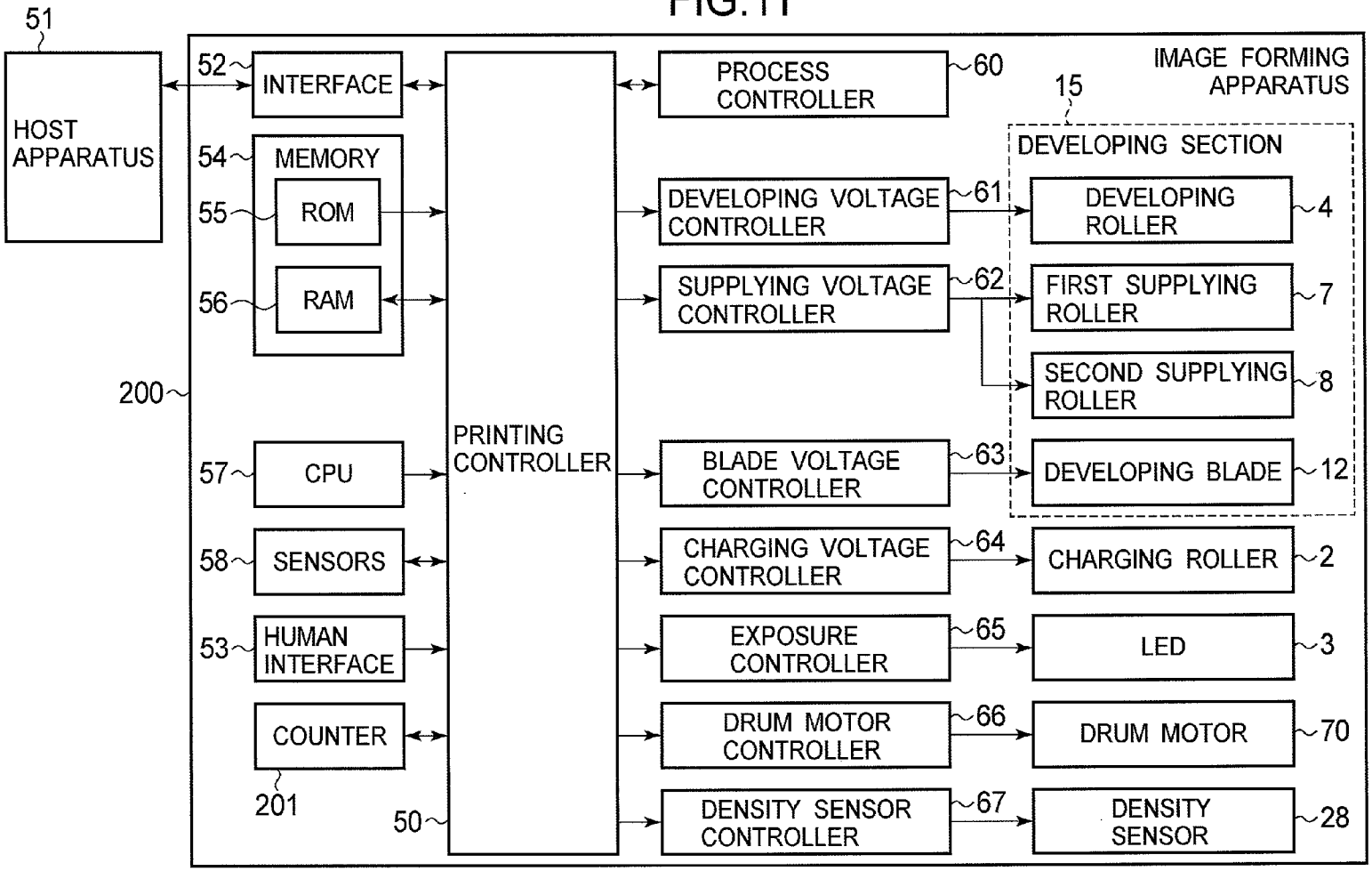
FIG. 11 is a block diagram illustrating the respective sections of an image forming apparatus according to a second embodiment, pertinent to the present invention.

FIG. 11 is a block diagram illustrating the respective sections, which are pertinent to the present invention, of an image forming apparatus 200 according to a second embodiment.

The second embodiment differs from the first embodiment in that a counter 201 is additionally employed and a printing process is performed in a different manner using the counter 201. Elements similar to those of the first embodiment have been given like reference characters and their description is omitted. The second embodiment will be described mainly in terms of portions different from the first embodiment. The pertinent portion of the configuration of the image forming apparatus 200 is common to that of the image forming apparatus 100 shown in FIGS. 1 and 2, and therefore the description will be made with reference to FIGS. 1 and 2.

The counter 201 counts the cumulative number of printed pages, N. The cumulative number of pages N is stored in a RAM 56 and is updated as the cumulative number of pages N increases. The counter 201 and RAM 56 constitute a counting section.

{Density Setting Operation}

Figure 12:
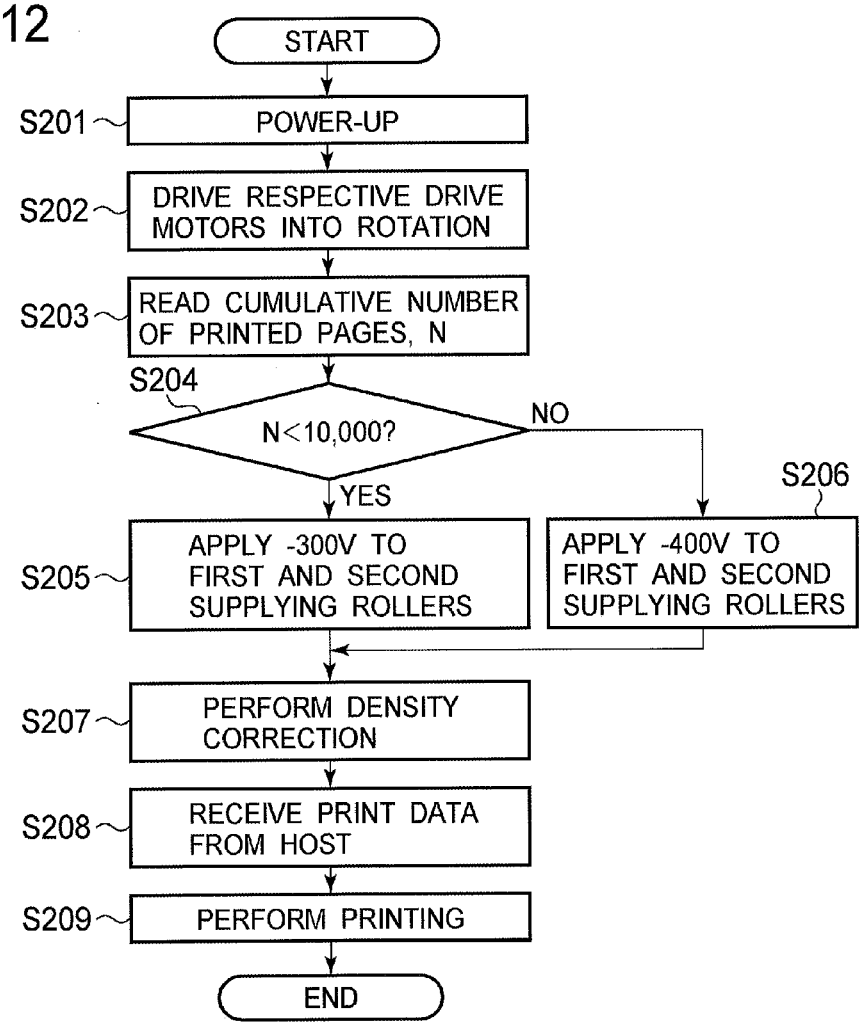
FIG. 12 is a flowchart illustrating an image density setting operation performed in the image forming apparatus of FIG. 11 prior to a printing operation.

FIG. 12 is a flowchart illustrating an image density setting operation performed in the image forming apparatus 200 prior to a printing operation. The image density setting operation will be described with reference to FIG. 12. Respective image forming sections 40K, 40M, 40Y, and 40C perform the image density setting operation in the same manner. Each of the image forming sections 40K, 40M, 40Y, and 40C may be substantially identical; for simplicity only the operation of the image forming sections 40K for forming black images will be described, it being understood that the other image forming sections 40M, 40Y, and 40C may work in a similar fashion.

A printing controller 50 detects power-up of the image forming apparatus 200 when the image forming apparatus 200 is turned on (S201). The printing controller 50 then drives a motor controller 66, thereby causing respective drum motors 70 to rotate at a predetermined circumferential speed (e.g., 130 mm/s) (S202). The gear ratios among the developing roller 4 and first and second supplying rollers 7 and 8 are selected such that when the photoconductive drum 1 rotates at a circumferential speed of 130 mm/s, the developing roller 4, the first supplying roller 7, and second supplying roller 8 rotate at circumferential speeds of 156 mm/s, 109 mm/s, and 93 mm/s, respectively. In other words, the ratio of the circumferential speed of the first supplying roller 7 to that of the developing roller 4K is 0.7, and the ratio of the circumferential speed of the second supplying roller 8 to that of the developing roller 4K is 0.6.

Next, the printing controller 50 reads the cumulative number of printed pages N from the RAM 56 (S203), and then makes a decision to determine whether the cumulative number of printed pages N is smaller than 10,000 (S204).

If N is smaller than 10,000 (YES at S204), the printing controller 50 refers to Table 2 held in the ROM 55 to read a voltage of −300 V, and applies the voltage of −300 V to both the first and second supplying rollers 7 and 8 (S205). If N≥10,000 (NO at S204), the printing controller 50 reads a voltage of −400 V from Table 2 and applies the voltage to the first supplying roller 7 and second supplying roller 8 (S206). On other words, the voltage is switched from −300 V to −400 V. In S205 and S206, a voltage of −1150 V is applied to a charging roller 2 and a voltage of −200 V is applied to the developing roller 4.

TABLE 2

| VOLTAGE (V) | |
|---|---|
| V1 | V2 |
| −300 | −400 |

The printing controller 50 then performs an image density correction so that image density or the density of a printed image is a level or value equivalent to OD=1.5 (S207). The image density correction is performed without changing the differences in voltage among the charging roller 2, the developing roller 4, the first supplying roller 7, and the second supplying roller 8.

After the image density correction, the printing controller 50 receives print data from a host apparatus 51 via an interface 52 (S208), and performs the normal printing operation of the image forming apparatus 200 (S209).

{Change in Ability to Supply Toner and to Scrape Toner}

Figure 13:
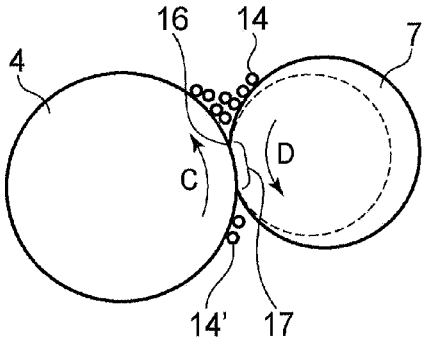
FIG. 13 illustrates the positional relation between the developing roller 4 and the first supplying roller 7.

FIG. 13 illustrates the positional relation between the developing roller 4 and the first supplying roller 7. The ability of the first supplying roller 7 to supply the toner and to scrape the toner varies with time. The change in the ability will be described with reference to FIG. 13.

As the foamed part on the outer peripheral portion of the supplying roller 7 wears with time, the outer diameter decreases as shown in dotted line in FIG. 13, causing the outer surface area to decrease. As a result, less toner is supplied to the developing roller 4 and the depth of a nip formed between the supplying roller 7 and the developing roller 4 also decreases causing less residual toner 14*a* to be scraped. Generally speaking, the higher the circumferential speed of the supplying roller is, the further the supplying roller wears. Thus, the ability of the supplying roller to supply the toner and to scrape the residual toner prominently decreases.

A description will be given of the relation among the ratios of the circumferential speed of the first and second supplying rollers 7 and 8 to that of the developing roller 4, the amount of toner deposited on the developing roller 4, and the image density when the voltages applied to the first and second supplying rollers 7 and 8 are changed from −300 V to −400 V.

It is assumed that the charging roller 2 receives a voltage of −1150 V and the developing roller receives a voltage of −200 V before and after the voltages applied to the first and second supplying rollers 7 and 8 are changed.

With the aforementioned voltages applied to the charging roller 2, developing roller 4, and the first and second supplying rollers 7 and 8, the image density correction is performed as in S207 so that the image density of the solid black "top" is equal to the target image density of OD=1.5. The voltages applied to the charging roller 2, developing roller 4, and the first and second supplying rollers 7 and 8 are adjusted while maintaining the differences in voltage among the charging roller 2, developing roller 4, and the first and second supplying rollers 7 and 8 unchanged.

During the image density correction, the ratio of the circumferential speed of the first supplying roller 7 to that of the developing roller 4 is 0.7, and the ratio of the circumferential speed of the second supplying roller 8 to that of the developing roller 4 is 0.6. In the present invention, print results are good if the image density of the solid black "top" is OD=1.5 and the difference in image density between the solid black "top" and the solid black "bottom" is not higher than OD=0.1. The image forming apparatus used in the test is configured such that the circumferential speeds of the first and second supplying rollers 7 and 8 can be selectively set.

{Configuration with a Single Supplying Roller}

Using the configuration shown in FIG. 17, a test was conducted to evaluate the relationship between the ratio of the circumferential speed of the supplying roller 7*a* to that of the developing roller 4 and the amount of toner deposited on the developing roller 4. The test results will be described with reference to FIG. 14.

Figure 14:
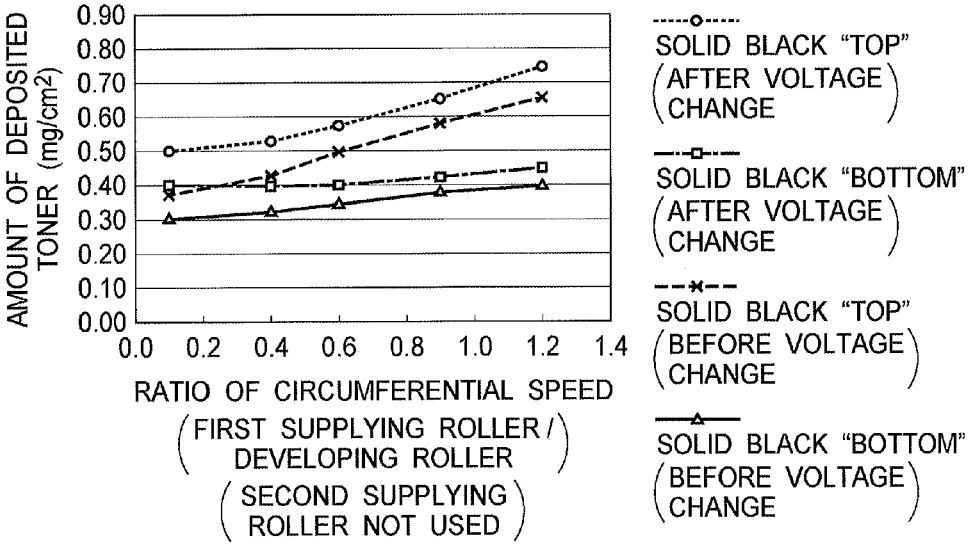
FIG. 14 illustrates the relationship between the ratio of the circumferential speed of the first supplying roller to that of the developing roller and the amount of toner deposited on the developing roller when a printing operation is performed using only the first supplying roller.

The image density was measured for the ratio of the circumferential speed of the first supplying roller 7 to that of the developing roller 4 in the range of 0.1 to 0.2. The developing roller 4 was maintained at a fixed circumferential speed (e.g., 156 mm/s) during each measurement. Solid black "top" is a leading portion of a solid black patch printed on the recording paper 19. Solid black "bottom" is a trailing portion of the solid black patch printed on the recording paper 19. The amount of toner deposited on the developing roller 4 for developing the solid black "top" shown in FIG. 14 is the amount of toner deposited on the developing roller 4 for the leading portion of a solid black image printed on the A4 size recording paper 19. The amount of toner deposited on the developing roller 4 for developing the solid black "top" shown in FIG. 14 is the amount of toner deposited on the developing roller 4 for developing the trailing portion of the solid black image printed on the A4 size recording paper 19.

When printing is performed on the A4 size paper in a landscape orientation, the developing roller 4 needs to make about four complete rotations. Thus, the solid black "top" is the amount of toner deposited on the developing roller 4 during the first rotation of the developing roller 4, and the solid black "bottom" is the amount of toner deposited on the developing roller 4 during the fourth rotation of the developing roller 4.

Referring to FIG. 14, if the voltage applied to the first supplying roller 7 is switched from −300 V to −400 V when printing has been performed on 10,000 pages, the amounts of the toner deposited on the developing roller 4 for the solid black "top" and solid black "bottom" will change. That is, the amount of toner is larger after the voltage is switched from −300 V to −400 V than before the voltage is switched from −300 V to −400 V. The amount of toner increases with increasing ratio of the circumferential speed of the first supplying roller 7 to that of the developing roller 4. However, if only the first supplying roller 7 is used to supply the toner to the developing roller 4, the problem of the test results shown in the first embodiment (FIG. 7) still remains unsolved.

Figure 15:
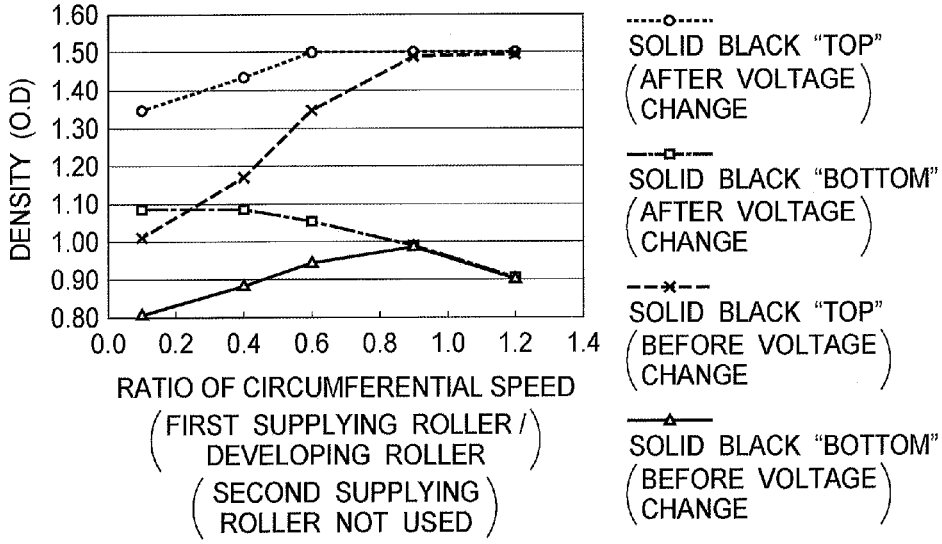
FIG. 15 illustrates the relationship between the ratio of the circumferential speed of the first supplying roller to that of the developing roller and the amount of toner deposited on the developing roller when a printing operation is performed using only the first supplying roller.

FIG. 17 illustrates a configuration in which the second supplying roller 8 is not used. A test was conducted to evaluate the relationship between the ratio of the circumferential speed of the supplying roller 7*a* to that of the developing roller 4 and the image density or the density of an image printed on the A4 size recording paper 19. FIG. 15 illustrates the test results.

The image density was measured for the ratio of the circumferential speed from 0.1 to 0.2. The developing roller 4 was maintained at a fixed circumferential speed (e.g., 156 mm/s) during each measurement. Solid black "top" is a leading portion of a solid black patch printed on the recording paper 19. Solid black "bottom" is a trailing portion of a solid black patch printed on the recording paper 19. The image density OD of solid black "top" shown in FIG. 15 is the image density of the leading portion of a solid black image printed on the A4 size recording paper 19. The image density OD of solid black "bottom" shown in FIG. 15 is the image density of the trailing portion of the solid black image printed on the A4 size recording paper 19.

As is clear from FIG. 15, switching the voltage applied to the first supplying roller 7 from −300 V to −400 V shortly after printing has been performed on 10,000 pages can increase the image density for both the solid black "top" and solid black "bottom," if the ratio of the circumferential speed of the first supplying roller 7 to that of the developing roller 4 is smaller than 0.9. It is also clear from FIG. 15 that if only the first supplying roller 7 is employed, the difference in image density between the solid black "top" and solid black "bottom" cannot be adjusted below OD=0.1 while maintaining the image density of the solid black "top" to OD=1.5.

Next, a test was conducted using both the first supplying roller 7 and second supplying roller 8. The test results will be described in terms of the relationship among the ratios of the circumferential speeds of the first and second supplying rollers 7 and 8 to that of the developing roller 4, the amount of toner deposited on the developing roller 4, and the image density.

The developing roller 4 rotated at a circumferential speed of 156 mm/s. The first supplying roller 7 rotated at a circumferential speed of 109 mm/s. In other words, the ratio of the circumferential speed of the first supplying roller 7 to that of the developing roller 4 was set to 0.7. The ratio of the circumferential speed of the second supplying roller 8 to that of the developing roller 4 was varied from 0.1 to 1.2.

Figure 16A:
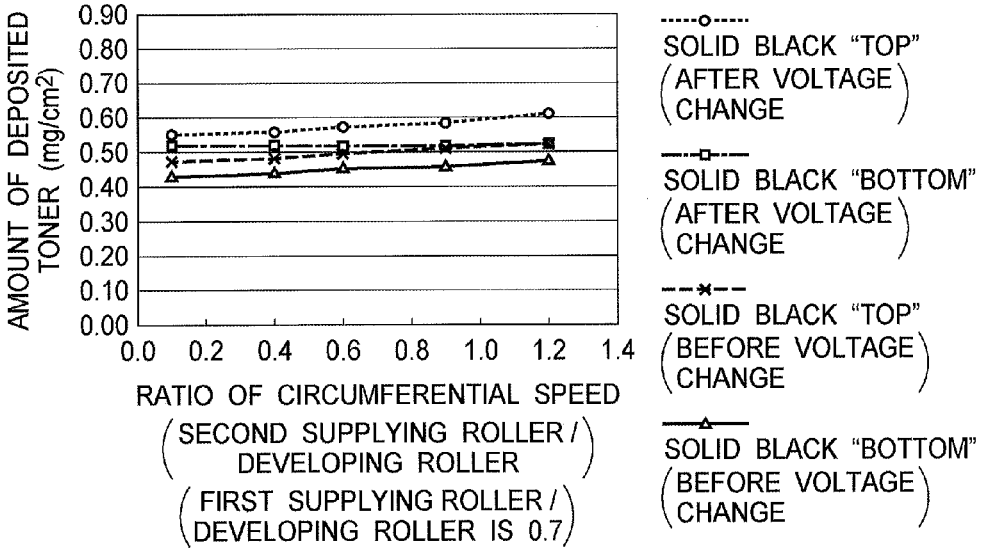
FIG. 16A illustrates the relationship between the ratio of the circumferential speed of the second supplying roller to that of the developing roller and the amount of toner deposited on the developing roller.

FIG. 16A illustrates the relationship between the ratio of the circumferential speed of the second supplying roller 8 to that of the developing roller 4 and the amount of toner deposited on the developing roller 4.

Figure 16B:
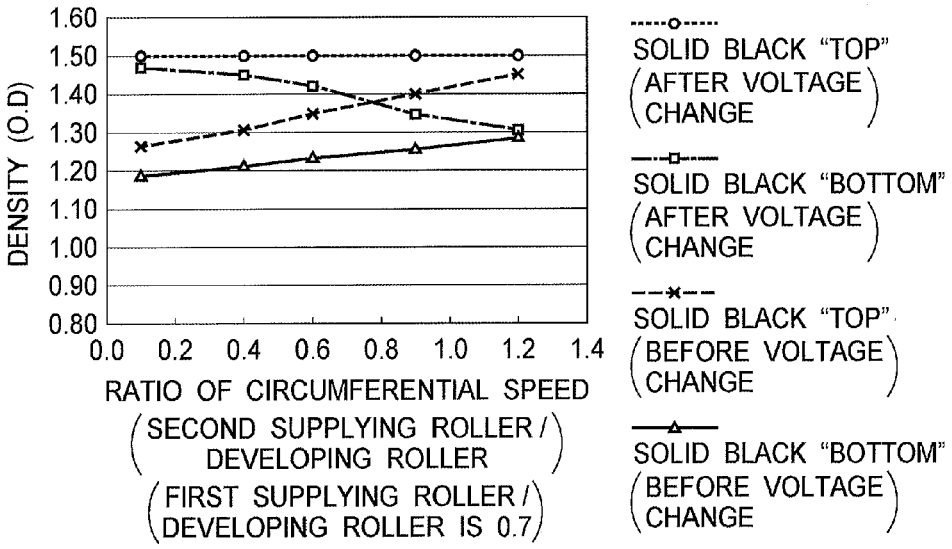
FIG. 16B illustrates the relationship between the ratio of the circumferential speed of the second supplying roller to that of the developing roller and the density of an image printed on the recording paper.

FIG. 16B illustrates the relationship between the ratio of the circumferential speed of the second supplying roller 8 to that of the developing roller 4 and the image density.

The amount of toner deposited on the developing roller for developing the solid black "top" and solid black "bottom" are similar to those shown in FIG. 14 and their description is omitted. The image density for solid black "top" and solid black "bottom" are similar to those shown in FIG. 15 and their description is omitted.

As is clear from FIG. 16A, switching the voltage applied to the first supplying roller 7 from −300 V to −400 V shortly after having printed on 10,000 pages of the recording paper 19 can increase the image density for both the solid black "top" and solid black "bottom". The amount of toner deposited on the developing roller 4 increases with decreasing ratio of the circumferential speed of the second supplying roller 8 to that of the developing roller 4, so that the difference in the amount of toner deposited on the developing roller 4 between the solid black "top" and solid black "bottom" decreases. This is because the ratio of the circumferential speed of the second supplying roller 8 to that of the developing roller 4 is in a narrow range and is therefore subject to less wear. Thus, the second supplying roller 8 minimizes the decrease in the amount of scraped toner over time and the decrease in the amount of toner supplied to the developing roller 4.

As is clear from FIG. 16B, the image density increases with decreasing the ratio of the circumferential speed of the second supplying roller 8 to that of the developing roller 4 for both the solid black "top" and solid black "bottom," if the voltage applied to the first supplying roller 7 is switched from −300 V to −400 V shortly after having printed on 10,000 pages of the recording paper 19 can increase. It is also clear from FIG. 16B that if the ratio of the circumferential speed of the second supplying roller 8 to that of the developing roller 4 is in the range of 0.1 to 0.6, the difference in image density between the solid black "top" and solid black "bottom" can be below OD=0.1 while maintaining the image density for the solid black "top" to OD=1.5.

The fact that the difference in image density can be below OD=0.1 is considered due to the increase in the amount of residual toner 14*a* scraped by the second supplying roller 8. The increase in the scraped amount of residual toner 14*a* results from the narrow range (i.e., 0.1 to 0.6) of the ratio of circumferential speed of the second supplying roller 8 to that of the developing roller 4.

As described above, the image forming apparatus according to the second embodiment employs first and second supplying rollers for a single developing roller. The image bearing body, first supplying roller, and second supplying roller are disposed around the single developing roller in this order so that the image bearing body is upstream of the second supplying roller with respect to rotation of the developing roller, and the second supplying roller is upstream of the first supplying roller. The two supplying rollers are disposed side by side along the rotational direction of the single developing roller, and rotate at different ratios of the circumferential speed to that of the developing roller. The ratio of the circumferential speed of a second supplying roller upstream with respect to rotation of the developing roller is selected to be smaller than that for a first supplying roller downstream of the second supplying roller. This configuration provides sufficient supply of toner to the developing roller and is sufficiently effective in scraping the residual toner from the developing roller 4, so that the difference or variation in image density within a page of the recording paper 19 can be minimized for high quality print image.

The first and second embodiments have been described with respect to a tandem image forming apparatus. The invention is not limited to a tandem image forming apparatus but may be applicable to an image forming apparatus having a monochrome image forming section, a four-cycle image forming apparatus with a single image bearing body, or a multi function peripheral such as a facsimile machine and a copying machine.

The invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. An image forming apparatus comprising:

a developer bearing body that faces an image bearing body that bears an electrostatic latent image thereon, the developer bearing body supplying a developer material to the image bearing body to develop the electrostatic latent image;

a first supplying member that supplies the developer material to the developer bearing body; and a second supplying member that is disposed upstream of the first supplying member with respect to a direction of rotation of the developer bearing body and supplies the developer material to the developer bearing body;

wherein a circumferential speed of the first supplying member is higher than a circumferential speed of the second supplying member;

wherein the first supplying member rotates in a direction in which the second supplying member rotates;

wherein the ratio of the circumferential speed of the first supplying member to a circumferential speed of the developer bearing body is larger than the ratio of the circumferential speed of the second supplying member to the circumferential speed of the developer bearing body; wherein the ratio of the circumferential speed of the second supplying member to the circumferential speed of the developing bearing body is equal to or smaller than 0.6.

2. The image forming apparatus according to claim 1, wherein the first supplying member rotates in a direction in which the developer bearing body rotates.

3. The image forming apparatus according to claim 1, wherein the second supplying member is in contact with the developer bearing body.

4. The image forming apparatus according to claim 1 further comprising:

a printing controller configured to perform overall control of the image forming apparatus;

a counter configured to count a cumulative number of printed pages;

a voltage applying section configured to apply a voltage to the first supplying member and a voltage to the second supplying member;

wherein the printing controller drives the voltage applying section to increase the voltages applied to the first supplying member and the second supplying member when the cumulative number of pages has reached a reference value.

5. The image forming apparatus according to claim 4, wherein the printing controller changes the voltage applied to the first supplying member and the voltage applied to the second supplying member, while maintaining a difference between the voltage applied to the first supplying member and the voltage applied to the second supplying member.

6. The image forming apparatus according to claim 1, wherein the ratio of a circumferential speed of the first supplying member to a circumferential speed of the developer bearing body is in a range of 0.7 to 1.3, and the ratio of the circumferential speed of the second supplying member to the circumferential speed of the developer bearing body is in a range of 0.1 to 0.6.

7. The image forming apparatus according to claim 1, wherein the first supplying member is in contact with the developer bearing body.

8. An image forming apparatus comprising:

a developer bearing body that faces an image bearing body that bears an electrostatic latent image thereon, the developer bearing body supplying a developer material to the image bearing body to develop the electrostatic latent image;

a first supplying member that supplies the developer material to the developer bearing body; and a second supplying member that is disposed upstream of the first supplying member with respect to a direction of rotation of the developer bearing body and supplies the developer material to the developer bearing body;

wherein a circumferential speed of the first supplying member is higher than a circumferential speed of the second supplying member;

wherein the first supplying member rotates in a direction in which the second supplying member rotates;

wherein the first supplying member is in contact with the developer bearing body; and wherein the developer bearing body and the first supplying member form a nip therebetween, the nip has a depth given as follows:

$$D=(r1+r2)-L\ 0.6\ \text{mm}\hat{}D\hat{}1.4\ \text{mm}$$

where D is the depth of the nip, r1 is the radius of the developer bearing body, r2 is the radius of the first supplying member, and L is the distance between the rotational axes of the first supplying member and the developer bearing body.

9. The image forming apparatus according to claim 8, wherein the ratio of the circumferential speed of the first supplying member to the circumferential speed of the developer bearing body is equal to or greater than 0.7.

10. The image forming apparatus according to claim 8, wherein the ratio of the circumferential speed of the first supplying member to the circumferential speed of the developer bearing body is larger than the ratio of the circumferential speed of the second supplying member to the circumferential speed of the developer bearing body.

11. The image forming apparatus according to claim 8, wherein the ratio of the circumferential speed of the second supplying member to the circumferential speed of the second circumferential speed of the developing bearing body is equal to or smaller than 0.6.

12. The image forming apparatus according to claim 8, wherein the first supplying member rotates in a direction in which the developer bearing body rotates.

13. The image forming apparatus according to claim 8, wherein the second supplying member is in contact with the developer bearing body.

14. The image forming apparatus according to claim 8, further comprising:

a printing controller configured to perform overall control of the image forming apparatus;

a counter configured to count a cumulative number of printed pages;

a voltage applying section configured to apply a voltage to the first supplying member and a voltage to the second supplying member;

wherein the printing controller drives the voltage applying section to increase the voltages applied to the first supplying member and the second supplying member when the cumulative number of pages has reached a reference value.

15. The image forming apparatus according to claim 14, wherein the printing controller changes the voltage applied to the first supplying member and the voltage applied to the second supplying member, while maintaining a difference between the voltage applied to the first supplying member and the voltage applied to the second supplying member.

* * * * *